US011078626B2

(12) United States Patent
Backfolk

(10) Patent No.: US 11,078,626 B2
(45) Date of Patent: Aug. 3, 2021

(54) METHOD OF MAKING A THERMOPLASTIC FIBER COMPOSITE MATERIAL AND WEB

(71) Applicant: STORA ENSO OYJ, Helsinki (FI)

(72) Inventor: Kaj Backfolk, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 15/309,286

(22) PCT Filed: May 6, 2015

(86) PCT No.: PCT/IB2015/053297
§ 371 (c)(1),
(2) Date: Nov. 7, 2016

(87) PCT Pub. No.: WO2015/170262
PCT Pub. Date: Nov. 12, 2015

(65) Prior Publication Data

US 2017/0067208 A1 Mar. 9, 2017

(30) Foreign Application Priority Data

May 8, 2014 (SE) ..... 1400228-1

(51) Int. Cl.
*D21H 13/12* (2006.01)
*D21H 17/70* (2006.01)
(Continued)

(52) U.S. Cl.
CPC ..... *D21H 13/12* (2013.01); *D21H 13/14* (2013.01); *D21H 13/24* (2013.01); *D21H 17/28* (2013.01);
(Continued)

(58) Field of Classification Search
CPC ..... D21H 13/24; D21H 13/40; D21H 13/14; D21H 17/675; D21H 13/12; D21H 17/37;
(Continued)

(56) References Cited

U.S. PATENT DOCUMENTS 2,526,125 A * 10/1950 Francis, Jr. ..... D21H 5/20 162/146
3,325,345 A * 6/1967 Hider ..... D21H 17/35 162/169
(Continued)

FOREIGN PATENT DOCUMENTS

CN 1723316 A 1/2006
CN 103210144 A 7/2013
(Continued)

OTHER PUBLICATIONS

Elias, Thomas C. in "Papermaking Materials Developed Since 1950," Senior Theses, Western Michigan University, pp. 1-45. (Year: 1959).*
(Continued)

*Primary Examiner* — Jose A Fortuna
(74) *Attorney, Agent, or Firm* — Greer, Burns & Crain, Ltd.

(57) ABSTRACT

A method for forming a thermoplastic composite material in a papermaking machine, wherein the method comprises the steps of: forming an aqueous fiber material suspension; bringing said fiber suspension in contact with at least one additive, said additive being introduced into said fiber suspension, whereby said additive reacts to form a precipitation product onto or into the fibers, thereby forming an intermediate suspension, introducing, after the formation of the intermediate suspension, a plastic material into said intermediate suspension, thereby forming a plastic fiber composite suspension.

19 Claims, 5 Drawing Sheets

(51) Int. Cl.

| | |
|---|---|
| ***D21H 13/14*** | (2006.01) |
| ***D21H 13/24*** | (2006.01) |
| ***D21H 17/35*** | (2006.01) |
| ***D21H 17/53*** | (2006.01) |
| ***D21H 17/00*** | (2006.01) |
| ***D21H 17/67*** | (2006.01) |
| ***D21H 17/37*** | (2006.01) |
| ***D21H 17/28*** | (2006.01) |

(52) U.S. Cl.
CPC ..... *D21H 17/35* (2013.01); *D21H 17/37* (2013.01); *D21H 17/53* (2013.01); *D21H 17/675* (2013.01); *D21H 17/70* (2013.01); *D21H 17/71* (2013.01)

(58) Field of Classification Search
CPC ..... D21H 17/67; D21H 17/28; D21H 17/53; D21H 17/70; D21H 11/20; D21H 13/10; D21H 17/24; D21H 17/63; D21H 27/00
See application file for complete search history.

(56) References Cited

U.S. PATENT DOCUMENTS 3,697,364 A 10/1972 Boustany et al.
3,912,581 A * 10/1975 Fink ..... C08F 2/18 162/164.1
3,943,079 A 3/1976 Hamed
4,140,566 A * 2/1979 Burton ..... B32B 29/02 156/219
4,257,842 A * 3/1981 Ciaccia ..... B44C 1/24 162/117
4,481,075 A * 11/1984 Dailly ..... D21H 13/16 162/145
4,510,020 A * 4/1985 Green ..... D21C 9/004 162/169
4,769,274 A * 9/1988 Tellvik ..... B29C 51/145 428/218
4,861,428 A * 8/1989 Van Breen ..... C08J 3/215 162/145
4,952,278 A * 8/1990 Gregory ..... D21H 11/18 162/141
5,091,055 A * 2/1992 Fredenucci ..... D21H 11/00 162/135
5,096,539 A * 3/1992 Allan ..... D21H 17/70 162/162
5,133,835 A * 7/1992 Goettmann ..... D04H 1/54 162/146
5,223,090 A * 6/1993 Klungness ..... D21C 9/004 162/181.2
5,614,312 A * 3/1997 Tucker ..... D21H 13/24 428/323
5,755,930 A 5/1998 Satterfield et al.
5,889,082 A * 3/1999 Kaminski ..... F16D 69/026 523/149
5,895,557 A * 4/1999 Kronzer ..... D21H 17/34 162/140
5,919,837 A * 7/1999 Kaminski ..... F16D 69/026 523/149
6,103,155 A * 8/2000 Uchida ..... B29C 39/14 264/108
7,985,801 B2 * 7/2011 Li ..... D04H 1/4291 524/474
8,758,566 B2 * 6/2014 Virtanen ..... D21H 17/70 162/141
9,297,112 B2 * 3/2016 Mesic ..... D21H 23/04
10,112,844 B2 * 10/2018 Fukuoka ..... D21H 19/385
10,253,455 B2 * 4/2019 Duhen ..... D21H 17/56
10,301,186 B2 * 5/2019 Fukuoka ..... D21H 19/385
2002/0088581 A1 * 7/2002 Graef ..... D21F 11/002 162/158
2002/0090474 A1 * 7/2002 Bean ..... D04H 1/64 428/36.3
2002/0100566 A1 * 8/2002 Lee ..... B32B 27/12 162/166
2003/0094252 A1 * 5/2003 Sundar ..... D21H 17/70 162/128
2004/0045687 A1 * 3/2004 Shannon ..... D21C 9/002 162/158
2004/0099389 A1 * 5/2004 Chen ..... D21F 9/00 162/134
2004/0108082 A1 6/2004 Hughes
2004/0131871 A1 * 7/2004 Lee ..... C08L 77/00 428/481
2005/0042518 A1 * 2/2005 Kinn ..... D04H 1/4382 429/250
2005/0136772 A1 * 6/2005 Chen ..... D04H 1/56 442/381
2006/0096051 A1 * 5/2006 Akai ..... A47L 13/20 15/104.93
2006/0121207 A1 * 6/2006 Prodoehl ..... D21H 21/22 427/458
2006/0134384 A1 * 6/2006 Vinson ..... D21H 27/008 428/153
2006/0183816 A1 8/2006 Gelman et al.
2007/0032157 A1 * 2/2007 McGrath ..... C03C 25/323 442/381
2007/0232175 A1 * 10/2007 Katayama ..... D01F 6/805 442/364
2008/0050565 A1 * 2/2008 Gross ..... B32B 5/22 428/212
2008/0210391 A1 * 9/2008 Pfalzer ..... D21C 9/004 162/4
2008/0233821 A1 9/2008 Ruf et al.
2009/0211720 A1 * 8/2009 Myllymaki ..... C08J 3/096 162/176
2010/0048768 A1 * 2/2010 Solhage ..... B32B 27/10 524/35
2010/0139877 A1 * 6/2010 Black ..... A22C 13/0003 162/146
2010/0193116 A1 * 8/2010 Gamstedt ..... D21H 13/12 156/246
2010/0212853 A1 * 8/2010 Klungness ..... D21C 9/004 162/181.4
2011/0000633 A1 * 1/2011 Kukkamaki ..... C01F 11/181 162/181.2
2012/0080156 A1 * 4/2012 Laleg ..... D21H 11/18 162/158
2012/0090800 A1 * 4/2012 Ture ..... B29C 70/465 162/164.1
2012/0219766 A1 * 8/2012 Gupta ..... D21H 15/02 428/195.1
2013/0062030 A1 3/2013 Imppola et al.
2013/0231419 A1 9/2013 Garrett et al.
2013/0280545 A1 10/2013 Husband et al.
2013/0312925 A1 11/2013 Saastamoinen et al.
2014/0134387 A1 * 5/2014 Yamada ..... B32B 5/18 428/95
2014/0259484 A1 * 9/2014 Baer ..... A47L 13/16 15/104.93
2015/0299959 A1 * 10/2015 Axrup ..... C08K 3/26 162/181.4
2015/0315749 A1 * 11/2015 Goeders ..... D21H 21/16 428/421
2016/0160443 A1 * 6/2016 Duhen ..... D21H 23/22 428/514
2016/0177512 A1 * 6/2016 Kawahara ..... B32B 23/08 435/289.1
2017/0067208 A1 * 3/2017 Backfolk ..... D21H 13/12
2017/0282467 A1 * 10/2017 Dorris ..... B29C 70/48
2017/0362775 A1 * 12/2017 Juvonen ..... D21H 15/06
2019/0063000 A1 * 2/2019 Backfolk ..... C01F 11/18
2019/0248988 A1 * 8/2019 Heiskanen ..... C08J 5/18
2019/0264394 A1 * 8/2019 Backfolk ..... D21H 21/06
2019/0276619 A1 * 9/2019 Saukkonen ..... D21H 25/04
2019/0276621 A1 * 9/2019 Heiskanen ..... D21H 25/04

(56) References Cited

U.S. PATENT DOCUMENTS

| | | | | |
|---|---|---|---|---|
| 2019/0292337 | A1* | 9/2019 | Heiskanen | C08J 5/045 |
| 2019/0292727 | A1* | 9/2019 | Backfolk | D21H 13/04 |

FOREIGN PATENT DOCUMENTS

| | | | | |
|---|---|---|---|---|
| CN | 106460339 | | 2/2017 | |
| EP | 0322287 | A1 * | 6/1989 | D21H 11/00 |
| WO | 2004053228 | | 6/2004 | |
| WO | WO-2009008822 | A1 * | 1/2009 | D21H 13/12 |
| WO | 2009153225 | | 12/2009 | |
| WO | 2012039668 | A1 | 3/2012 | |
| WO | 2013169203 | A1 | 11/2013 | |
| WO | WO-2017137941 | A1 * | 8/2017 | C01F 11/18 |

OTHER PUBLICATIONS

International Search Report for PCT/IB2015/053297, dated Aug. 25, 2015.

Gao, Jie et al., Effects of In Situ Deposited Calcium Carbonate Particles on Tensile Performance of Single Bamboo Fiber, Proceedings of the 55th International Convention of Society of Wood Science and Technology, Aug. 27-31, 2012, Beijing, China.

* cited by examiner

Fig. 3.b

METHOD OF MAKING A THERMOPLASTIC FIBER COMPOSITE MATERIAL AND WEB

This application is a U.S. National Stage under 35 U.S.C. § 371 of International Application No. PCT/IB2015/053297, filed May 6, 2015, which claims priority to Swedish application No. 1400228-1 filed May 8, 2014.

TECHNICAL FIELD

The present document relates to a method of making a composite comprising thermoplastic particles and lignocellulosic fibers.

BACKGROUND

Currently, wood-plastic composite material can be made either by making a masterbatch by mixing dry compounds and thus obtaining a masterbatch or intermediate product of thermoplastic granules, fillers, fibers and other additives. In some cases, this product can also be prepared to final composition, i.e. no further compounding with plastic is required. The problem with dry mixing or compounding is to ensure that wood fibers are evenly distributed into the plastic matrix. Another challenge is to ensure that the fiber is compatible with the plastic. In the latter case, compatibility agents or coupling agents are used to enhance the adhesion. The addition of these also possesses the same problem, i.e. the mixing of chemical into dry mixtures is difficult and quality depends on mixing efficiency. Fillers are often added to either reduce costs or adjust properties of the plastic such as optical-, mechanical, barrier-, or electrical properties. However, the mixing of the fillers into the matrix is challenging particularly for semi-dry or dry batches.

Another way to make a thermoplastic composite is to mix fibers and plastic compounds in wet phase and then dewater the said suspension prior to drying. One approach is to use a papermachine based process in which dewatering occurs on wire. However, the reinforcement effect of fiber is dependent on the fiber-fiber flocculation and fiber-pigment flocculation prior to immobilization and consolidation of the matrix. It is thus beneficial to have weak or very limited physical and/or mechanical interaction between fibers or, alternatively a 3D structure that is easily wetted by the plastic matrix.

U.S. Pat. No. 6,103,155 discloses a wet forming process for producing a fiber reinforced thermoplastic resin sheet with no or reduced warpage. This sheet is produced by feeding a thermoplastic resin and a reinforcing fiber into a dispersion tank, to which an aqueous medium containing a surface active agent or thickener is added at a pre-determined ratio. The mixture is stirred to prepare a dispersion as a material solution. This solution is then pumped to a web-forming section, where the dispersion is fed onto an endless mesh belt, while controlling the suction and filtration process, the speed of feeding the dispersion onto the belt and speed of said mesh belt to achieve a fiber orientation that is advantageous.

In WO2012/122224 A1 another wet web forming method is disclosed, wherein hydrogen bonds between the natural fibers are inhibited, and bonds between the fibers and the plastic particles are promoted. In this method the size of the powdery plastic particles, and the use of a compatibility-improving agent are essential to achieve a homogenous mixture of natural fibers and plastic material. WO2012/122224 A1 describes that the natural fiber, plastic, liquid and compatibilizing agent are fed to a mixing tank, and that the mixture is stirred overnight. This mixture can then be diluted to so called headbox consistency and brought to a conventional Fourdrinier machine for forming a web which is pressed and dried to form composite thermoplastic sheets. There is thus a need for a simplified process of forming a thermoplastic composite material,

SUMMARY

It is an object of the present disclosure, to provide an improved method for forming a thermoplastic composite material based on a web forming technique and more precisely a method of reducing the fiber-fiber contact and thus preventing strong inter-fiber bonding or/and flocculation in the composite or intermediate product. Another object of the present invention is to improve the dewatering and the dosing of fillers into the composite material.

The invention is defined by the appended independent claims. Embodiments are set forth in the appended dependent claims and in the following description and drawings.

According to a first aspect, there is provided a method for forming a thermoplastic composite material wherein the method comprises the steps of:

forming an aqueous fiber material suspension; bringing said fiber suspension in contact with at least one additive, said additive being introduced into said fiber suspension, whereby said additive reacts to form a precipitation product onto or into the fibers, thereby forming an intermediate suspension, introducing, after the formation of the intermediate suspension, a plastic material into said intermediate suspension, thereby forming composite material.

This method allows for a fast, simple and efficient way of producing a wood-plastic composite material. This method allows for at-line or near site or in-line precipitated pigment particles to be formed on the surface of the fibers which provides for a more even distribution of fillers, improves dewatering of the wet web, lowers costs, and prevents too strong fiber-fiber bonds and flocks which can affect distribution of fibers in the composite web. Uncontrolled distribution of fillers and fibers might lead to product quality variations or reduced physical, optical or mechanical properties of the product. This thermoplastic web can be further used as intermediate product for making a master batch or then for directly pressing the web or sheets into a molded product. In the latter case, it is of essential importance that the distribution of fibers and fillers are evenly distributed.

According to one alternative the thermoplastic composite material may comprise a webmaterial formed in a fibrous web making machine. This allows for the composite material to be formed in a conventional papermaking machine, which is cost efficient.

The web material may also be formed in a machine comprising a wire for dewatering the said wet web or furnish.

According to one embodiment the plastic material may comprise any one of a plastic particle material, a plastic fiber material or a mixture thereof.

The method may further comprise introducing said at least one additive in a liquid flow of a short circulation of a fibrous web forming process of a fibrous web machine, in an in-line production method for forming said reaction agent onto or into the fibers of the fiber suspension.

By utilizing an in-line production method there is provided a method which allows for an efficient mixing in the wet end of the paper making machine. The in-line production method also allows for a direct precipitation of a filler such as PCC onto or into the fibers of the suspension.

Alternatively the additive may be introduced into the fiber suspension in for instance a mixing tank prior to the introduction into the papermaking machine, or headbox of a fibrous web machine. According to yet an alternative the fiber suspension, additive and plastic material are all mixed in the headbox.

According to one alternative of the first aspect of the invention, when there are two or more additives, the method may further comprise allowing these to react with one another to form the precipitation product onto or into the fibers.

It has surprisingly been found that the use of carbonation onto fibers solves the aforementioned problems and prevents strong fiber-fiber flocs and bonds in a wet forming of a thermoplastic web. By utilizing pre-determined conditions, it is possible to precipitate filler (or another inorganic material) on the fibers and hence prevent strong fiber-fiber interaction.

According to an embodiment, the precipitation product may comprise acrystallized filler, or mixtures thereof, and wherein the additives are carbon dioxide and lime milk, said carbon dioxide and lime milk being fed to the short circulation separately or simultaneously, wherein said precipitation product or filler is allowed to precipitate onto or into the fibers of the fiber suspension, thereby forming the intermediate suspension, comprising precipitated calcium carbonate onto or into said fibers.

The filler can actually be crystalline or semi-crystalline or amorphous.

By precipitating PCC onto the fibers it is possible to further enhance dewatering and reduce costs of the thermoplastic composite.

According to yet an embodiment a coupling agent may be introduced into the intermediate suspension simultaneously with, or substantially directly after, the introduction of said additive.

The introduction of a coupling agent may improve the adherence between the plastic material and the fiber, and thus improve the characteristics of the composite material. The said coupling agent can also be utilized to control the morphology and/or chemistry of the fillers.

According to an alternative embodiment of the first aspect, the method may comprise the step of, before the step of bringing said fiber solution in contact with at least one additive, separating said fiber suspension into two separate flows, a first flow which is subsequently brought into contact with said additive, and a second flow, which is subsequently re-introduced into the intermediate suspension.

According to this alternative it may further be possible to precipitate the PCC only on one fraction such as refined or fibrillated fiber or nanofibers, whereas large fibers (normal) are remain untreated by the process. Alternatively, the larger (normal) fiber fraction is treated by the process, which fraction is later mixed with untreated refined/fibrillated or nanofibers.

The fiber used in the first aspect of the invention may be any one of an organic fiber such as natural lignocellulosic fiber, wood fiber, bleached kraft fiber, dissolving pulp fiber, microfibrillated cellulose, or inorganic fibers such as glass fibers, metal fibers, plastic fibers, thermo treated fibers. The liquid flow may comprise at least one of the following components: virgin pulp suspension (long-fiber pulp, short-fiber pulp, mechanical pulp, chemo mechanical pulp, chemical pulp, microfiber pulp, nanofiber pulp), recycled pulp suspension (recycled pulp, reject, fiber fraction from the fiber recovery filter), additive suspension and solids-containing filtrate.

The plastic material may be any one of a plastic selected from the group of polyethylene (PE), polypropylene (PP), ethylene/propylene copolymer, polycarbonate (PC), polystyrene (PS), polyethylene terephthalate (PET), polylactic acid (PLA), polyhydroxybutylate, acrylonitrile/butadiene/styrene copolymer (ABS), styrene/acrylonitrile copolymer (SAN), polyoxymethylene (POM), biodegradable thermoplastics, starch-based thermoplastics, their derivatives and/or mixtures thereof.

Alternatively any suitable plastic material may be used. Plastic materials derived from biobased resources can also be used.

According to an alternative embodiment the plastic-fiber composite suspension may be dewatered and pressed to a product in or after the paper machine. The web or sheet can be further laminated to provide a composite product.

According to another embodiment the plastic fiber composite suspension may be dewatered, dried and possible used as a master batch, and thereafter extruded to form a product.

According to yet another embodiment the plastic fiber composite suspension may be dewatered in a mould after which an object is formed.

According to another alternative embodiment the plastic fiber composite suspension may be transferred to a headbox of a fiber web machine.

According to this embodiment said plastic fiber composite solution may further fed onto a wire section of a fiber web machine, thereby forming a plastic fiber composite web material.

According to a second aspect of the present disclosure there is provided a plastic fiber composite material obtained by the method according to the first aspect.

The plastic fiber composite material or thermoplastic composite material thereby has improved qualities over prior art composites.

BRIEF DESCRIPTION OF THE DRAWINGS

Embodiments of the present solution will now be described, by way of example, with reference to the accompanying schematic drawings.

FIGS. 3*a-b* shows schematically a short circulation arrangement according to one alternative embodiment of the invention.

DESCRIPTION OF EMBODIMENTS

Definition of Precipitated Calcium Carbonate (PCC)

Almost all PCC is made by direct carbonation of hydrated lime, known as the milk of lime process. The lime is slaked with water to form $Ca(OH)_2$ and in order to form the precipitated calcium carbonate (insoluble in water) the slaked lime is combined with the (captured) carbon dioxide. The PCC may then be used in paper industry as a filler or pigmentation, mineral or coating mineral or in plastic or barrier layers. It can also be used as filler in plastics or as additive in home care products, tooth pastes, food, pharmaceuticals, paints, inks etc.

Definition of in-Line Precipitated Calcium Carbonate Process

By "in-line production" is meant that the precipitated calcium carbonate (PCC) is produced directly into the flow of the paper making stock, i.e. the captured carbon dioxide is combined with slaked lime milk inline, instead of being produced separately from the paper making process. Separate production of PCC further requires the use of retention chemicals to have the PCC adsorbed or fixed onto the fibers. An in-line PCC process is generally recognized as providing a clean paper machine system, and there is a reduced need of retention chemicals. An in-line PCC process is for instance disclosed in WO2011/110744.

Figure 1:
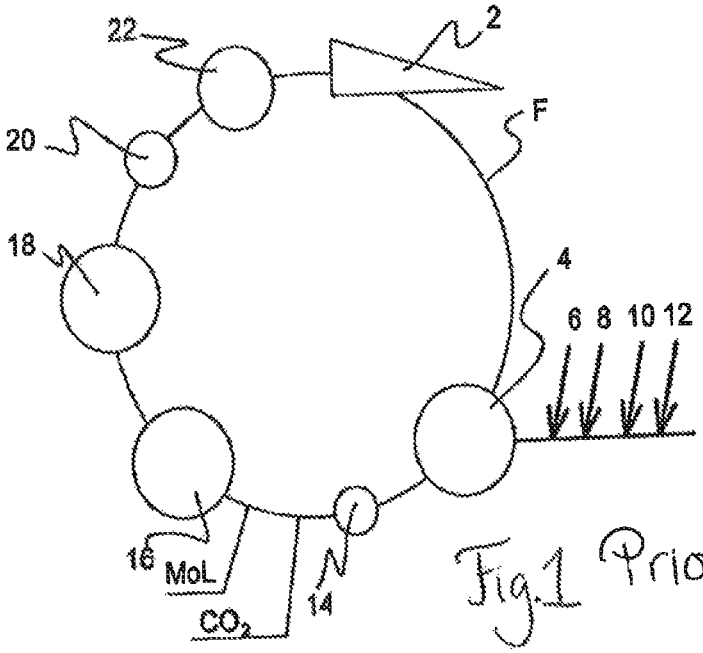
Fig. 1 Prior Art
FIG. 1 shows schematically a short circulation arrangement according to prior art.

FIG. 1 shows a prior art method for inline production of precipitated calcium carbonate, as disclosed in US2011/0000633 and a schematic process arrangement for a paper making machine 2. The white water F, is carried to e.g. a mixing tank or filtrate tank 4, to which various fibrous components are introduced for the paper making stock preparation. From fittings at least one of virgin pulp suspension (long-fiber pulp, short-fiber pulp, mechanical pulp, chemomechanical pulp, chemical pulp, microfiber pulp, nanofiber pulp), recycled pulp suspension (recycled pulp, reject, fiber fraction from the fiber recovery filter), regenerated cellulose, dissolving pulp, additive suspension and solids-containing filtrate is carried to the mixing tank, and from there conveyed by a mixing pump 14 to a vortex cleaner 16, where heavier particles are separated. The accept of the vortex cleaning continues to a gas separation tank 18, where air and/or other gases are removed from the paper making stock. The paper making stock is then transported to a feed pump 20 of the headbox, which pumps the paper making stock to a so-called headbox screen 22, where large sized particles are separated from the paper making stock. The accept faction is carried to the paper making machine 2 through its headbox. The short circulation of fiber web machines producing less demanding end products may, however, not have a vortex cleaner, gas separation plant and/or headbox.

In the prior art process the PCC production is performed in the short circulation of the paper making machine, before the vortex cleaning plant 16. The carbon dioxide ($CO_2$) is injected on the pressure side of the vortex cleaner and the lime milk (MoL) is injected a few meters after the carbon dioxide has dissolved in the same pipe. It is however conceivable that this PCC production could take place closer to the headbox, or that the distance between the injectors is very small, virtually injecting carbon dioxide and lime milk at the same location in the short circulation. This depends on the requirements of the end product and the design of the paper making machine.

Where two or more additives are fed into the short circulation these are preferably allowed to react with one another, which means that they are fed into the short circulation in a manner which allows for the additives to react, in the case of lime milk and carbon dioxide, such that precipitated calcium carbonate is formed onto or into the fibers as the reaction agent.

According to one embodiment of the present invention, an in-line PCC process is combined with the dosage of fibers into the in-line PCC process.

In one embodiment of the present invention, lime milk, carbon dioxide and fiber solution are injected separately into the short circulation and fibrous web of the paper making machine.

In an alternative embodiment, the fiber solution is provided e.g. in the preparation of the paper making stock, and thus is present in the paper making stock and the carbon dioxide and lime milk are injected separately or simultaneously into the short circulation.

In all of the above described embodiments it is to be understood that the order of injection of the additives, i.e. lime milk, carbon dioxide, fiber solution and possibly other additives may occur in a different order or at a different stage in the short circulation. It is conceivable that the injection occurs very close to the headbox, or that the fiber solution dosage is prior to the addition of the carbon dioxide or that the distances between the "injection points" is shorter or longer than described above. Thus the fiber solution, lime milk and carbon dioxide may be injected into the short circulation substantially at the same injection point.

The point or point where the injection takes place thus forms a "PCC reaction zone".

Figure 2:
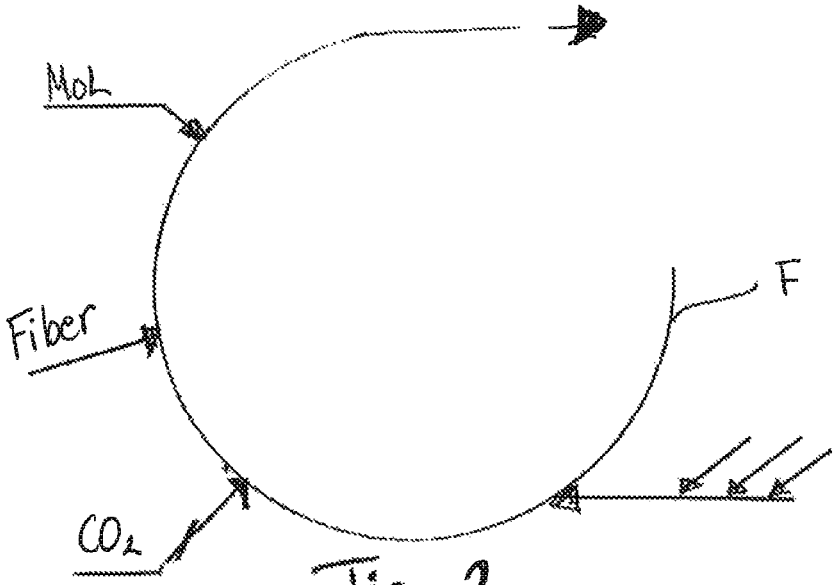
FIG. 2 shows schematically a short circulation arrangement according to one embodiment of the invention.

In one embodiment of the present invention, as shown in FIG. 2 lime milk, carbon dioxide and fiber solution are injected separately into the short circulation and fibrous web of the paper making machine.

Figure 3A:
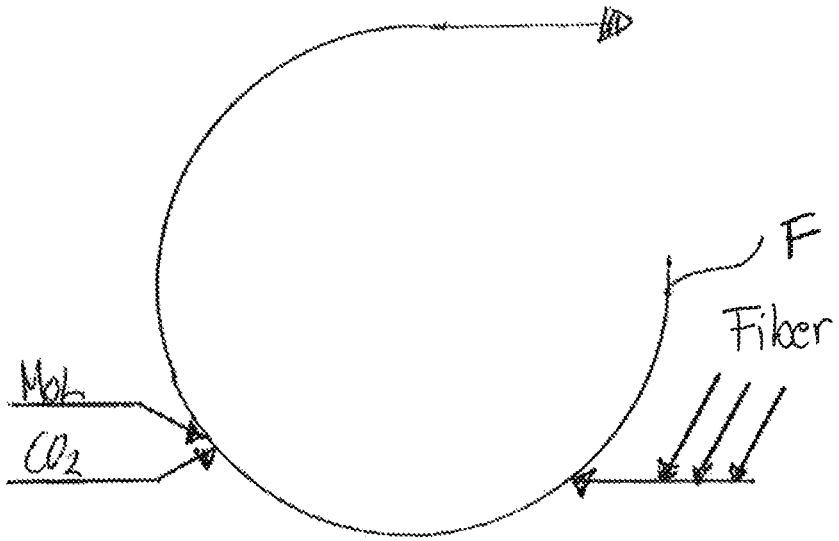
Figure 3A:
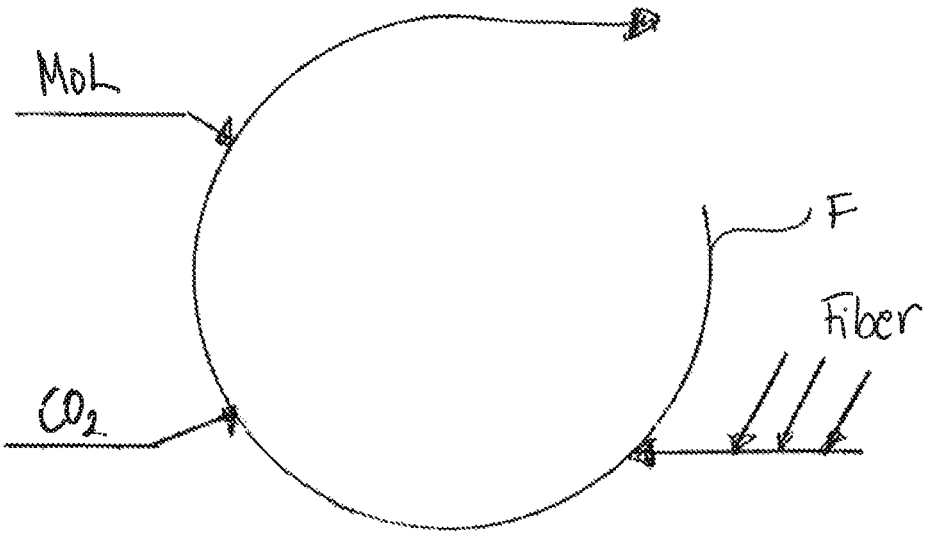

In an alternative embodiment, as shown in FIGS. 3*a* and 3*b* the fibers are provided e.g. in the preparation of the paper making stock, and thus is present in the paper making stock and the carbon dioxide and lime milk are injected separately or simultaneously into the short circulation.

Figure 4:
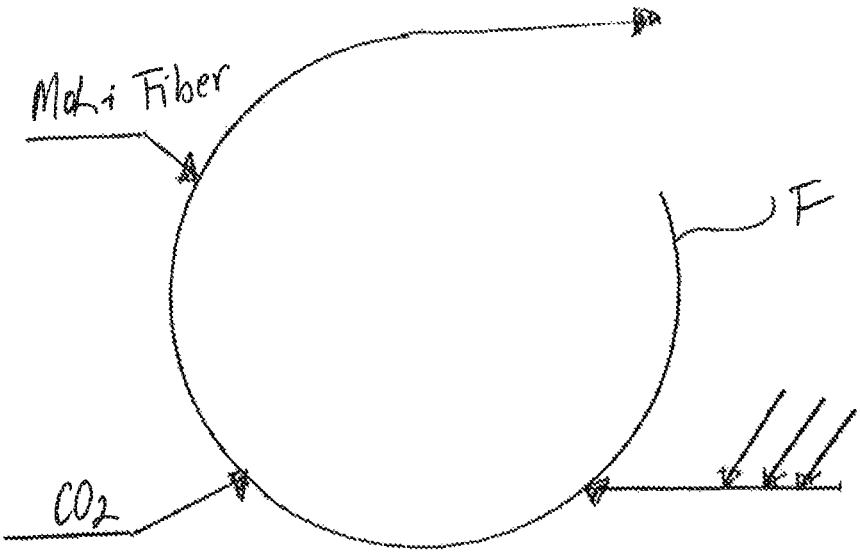
FIG. 4 shows schematically a short circulation arrangement according to yet an alternative embodiment of the invention.

In yet an alternative embodiment, as shown in FIG. 4 the lime milk and the fibers are mixed before the injection into the short circulation and the carbon dioxide is injected separately from this mixture.

Figure 5:
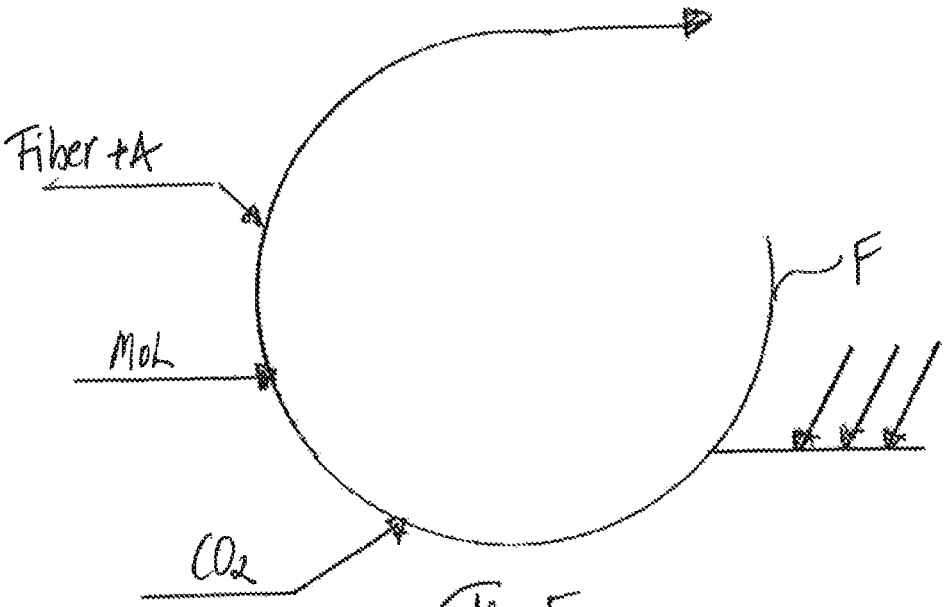
FIG. 5 shows schematically a short circulation arrangement according to yet another alternative embodiment of the invention.

In yet another alternative embodiment, as shown in FIG. 5, the fibers are mixed with other additives and this mixture is injected separately from the lime milk and carbon dioxide.

Alternatively other fillers may be used, such as silicate, calcium silicate, or other types of fillers based on alkaline earth carbonates, such as magnesium carbonate.

The first additive may be sodium silicate and the second additive an acidic media thereby forming silica.

The first additive may be calcium hydroxide, CaOH, and the second additive may be carbon dioxide CO2, and a third additive may be sodium silicate thereby forming calcium silicate.

The first additive may be another hydroxide of an alkaline earth metal (e.g. MgOH), and the second additive may be carbon dioxide, CO2, thereby forming other types of fillers based on alkaline earth carbonates, such as e.g. magnesium carbonate.

Figure 6:
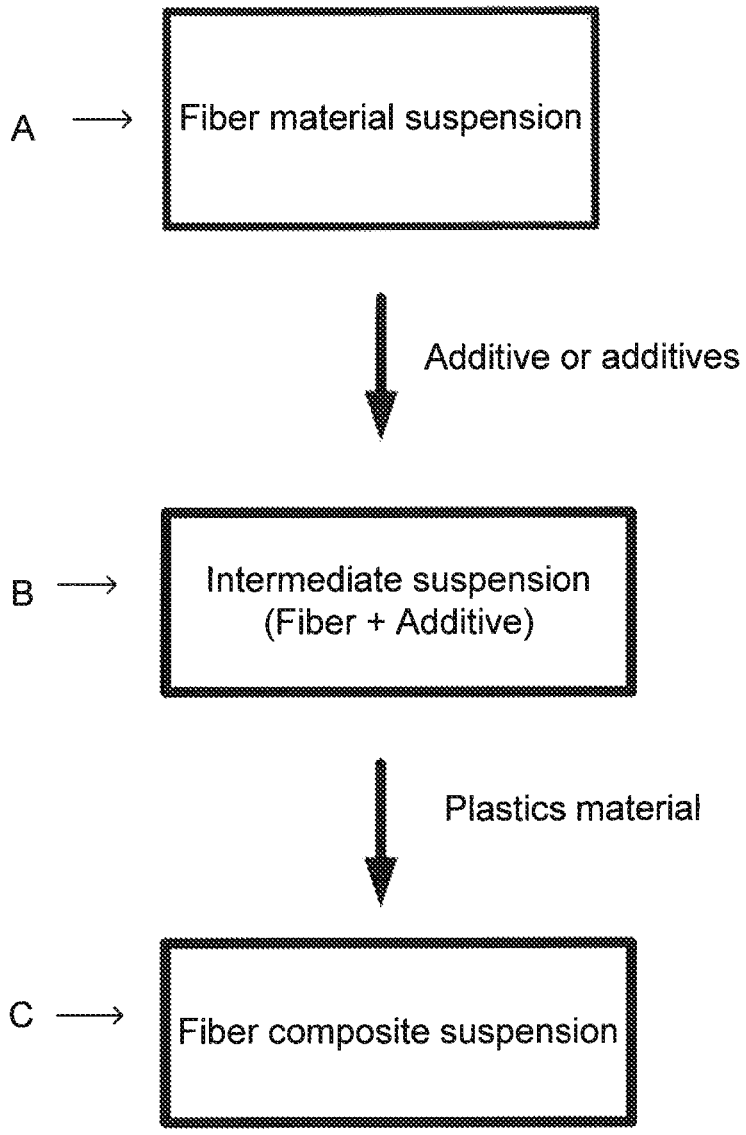
FIG. 6 shows a schematic flow scheme of the present invention.

In FIG. 6 an overview of the method is shown. In step A a fiber material suspension is provided. This suspension may comprise any of the aforementioned fibers. The fiber suspension is then contacted with one or more additives, either as an in-line process or in a batch operation. In step B the formed intermediate suspension comprises the fibers and the additives, where the additives may be a precipitation agent, such as PPC which may have been formed onto the fibers of the fiber suspension.

In step C the intermediate suspension is contacted with a plastics material, which may be any of the aforementioned materials. The resulting material is a suspension comprising a composite of plastic and fiber, which may then be further processed, for instance as described below. If the process is an in-line production method all of these steps may be performed more or less simultaneously. It is however preferred that the intermediate suspension, i.e. the precipitation product is formed before the plastics material is added. In the in-line production method the formation of the intermediate suspension can be very rapid, thus allowing for a very efficient way to form the plastics fiber composite.

According to one alternative the method provides for a separation of material or suspension flows, such that in step A before the fiber suspension is contacted with with at least one additive, the fiber suspension is separated into two separate flows, a first flow which is subsequently brought into contact with said additive, and a second flow, which is subsequently re-introduced into the intermediate suspension. According to this alternative it may further be possible to precipitate the PCC only on one fraction such as nanofibers, whereas large fibers (normal) are remain untreated by the process.

In the present disclosure different types of plastics materials may be used to form the thermoplastic composite material. Such materials include the aforementioned materials, but may also include a fiber type of thermoplastic material or mixture of two or several thermoplastic materials. The material may also contain a coupling agent that improves the adhesion between fibers or fiber-filler and plastic.

Alternatively the additive may be introduced into the fiber suspension in for instance a mixing tank prior to the introduction into the papermaking machine, or headbox of a fibrous web machine. According to yet an alternative the fiber suspension, additive and plastic material are all mixed in a headbox of a papermaking machine.

According to one embodiment a thermoplastic web according to the present disclosure may be produced in a conventional type of paper making machine. An example of such a paper machine 60 is shown in FIGS. 7*a* and 7*b*, where FIG. 7*b* is a continuation of FIG. 7*a*.

Figure 7A:
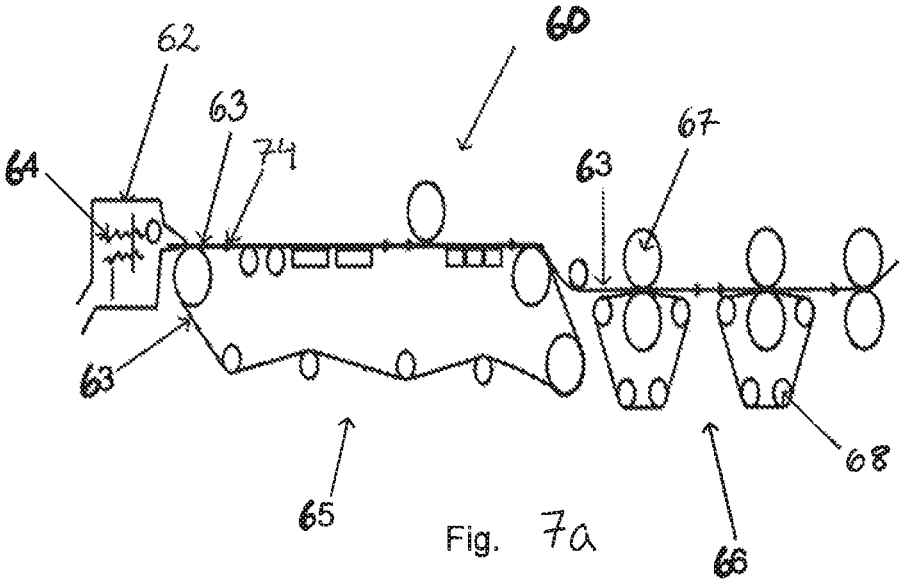
FIGS. 7*a* and 7*b* are a schematic side views of a conventional paper making machine.
Figure 7B:
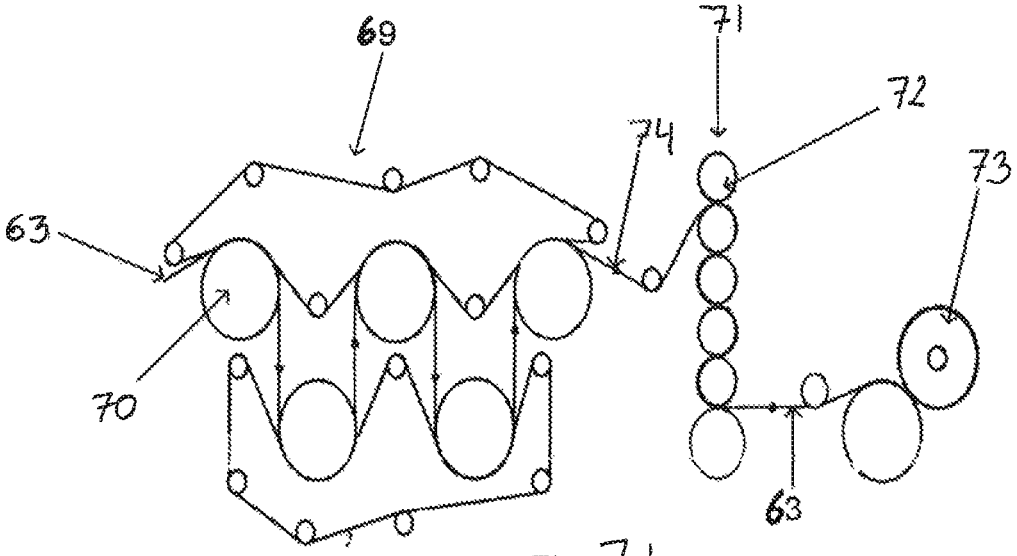

FIG. 7*a* illustrates a forming section 65 or the so called wet end of the paper making machine and a pressing or wet pressing section 66. In the head box 62 a stock solution or suspension 4 is usually provided and prepared. The stock solution 64 may for instance be heated to a desired temperature, or run through sieves to remove impurities etc. In the head box 62 different types of paper making additives or chemical aid may also be added to the stock solution, for instance, but not limited to additives such as retention chemicals, fillers and surface active agents or polymers.

In the present invention the plastic fiber composite solution may be transferred to the headbox 62.

Other types of additives that may be added in the wet end or size press may be additives such as starch, PVOH, CMC, or latex (SB, SA), cross-linkers, optical brighteners or colorants, biocides, fixatives, lubricants, preservatives, dispersants, etc.

The stock suspension 64, containing the plastic fiber composite solution, is provided onto a wire 63 in the forming section 65. A wet web 63 is thereby formed on the wire. An arrow 64 indicates the direction of the web or the machine direction.

After the forming section 65 the web passes through a pressing section 66, or a wet pressing section. The pressing operation may be performed by passing the wet web 63 through a series of nips, which are formed by rolls 67 pressing against each other, and are aided by press felts 68 which absorb the pressed water from the web.

After the wet pressing operation the web or sheet material 63, may be passed through a drying section 69. The drying may be performed in many different manners, but one way is to use drying cylinders 70 and steam. After the drying section 69 the web or sheet 63 may pass through a calender section and a series of calenders (heavy steel rolls) 72 to smooth the sheet, and finally rolled onto a roll or reel 73.

The invention claimed is:

1. A method for forming a thermoplastic composite material comprising organic fiber material and thermoplastic material, wherein the method comprises the steps of:

forming an aqueous suspension of the organic fiber material, wherein the organic fiber material includes at least one of a group consisting of natural fiber, wood fiber, bleached kraft fiber, dissolving pulp fiber, and microfibrillated cellulose;

separating said fiber suspension into a first flow and a second flow, wherein said first flow comprises refined fibers or fibrillated fibers or nanofibers;

bringing the first flow of said fiber suspension in contact with at least one additive, said additive being introduced into said fiber suspension, before the introduction of the thermoplastic material wherein the thermoplastic material is a fiber formed from a thermoplastic, whereby said additive reacts to form an inorganic precipitation product, wherein said inorganic precipitation product comprises a crystallized filler, and wherein said at least one additive comprises carbon dioxide and lime milk, wherein said precipitation product or filler precipitates onto the fibers of the aqueous suspension, thereby forming an intermediate suspension wherein fiber-fiber bonds are reduced and comprising precipitated calcium carbonate onto said fibers; and, introducing the second flow of said fiber suspension to said intermediate suspension; wherein after the formation of the intermediate suspension, the thermoplastic material is introduced into said intermediate suspension, thereby forming a thermoplastic composite material, wherein the thermoplastic includes at least one of a group consisting of polyethylene (PE), polypropylene (PP), ethylene/propylene copolymer, polycarbonate (PC), polystyrene (PS), polyethylene terephthalate (PET), polylactic acid (PLA), polyhydroxybutylate, acrylonitrile/butadiene/styrene copolymer (ABS), styrene/acrylonitrile copolymer (SAN), polyoxymethylene (POM), biodegradable thermoplastics, starch-based thermoplastics, their derivatives, and mixtures thereof, wherein the thermoplastic composite material comprises a web material formed in a fibrous web papermaking machine.

2. The method as claimed in claim 1, wherein the method comprises introducing said at least one additive in a liquid flow of a short circulation of a fibrous web forming process of the fibrous web machine, in an in-line production method for forming said reaction agent onto or into the fibers of the fiber suspension.

3. The method as claimed in claim 1, further comprising allowing the carbon dioxide and lime milk to react with one another to form the precipitation product onto the fibers.

4. The method as claimed in claim 1, wherein said carbon dioxide and lime milk being fed to the short circulation simultaneously.

5. The method as claimed in claim 1, wherein a coupling agent is introduced into the intermediate suspension simultaneously with, or substantially directly after, the introduction of said additive.

6. The method as claimed in claim 1, wherein the thermoplastic and fiber composite suspension is dewatered and pressed to a product in the paper machine.

7. The method as claimed in claim 1, wherein the thermoplastic and fiber composite suspension is dewatered and thereafter extruded to form a product.

8. The method as claimed claim 1, wherein the thermoplastic and fiber composite suspension is dewatered in a mould after which an object is formed.

9. The method as claimed in claim 1, wherein said thermoplastic and fiber composite suspension is transferred to a headbox of the fiber web machine.

10. The method as claimed in claim 1, wherein the liquid flow comprises at least one of the following components: virgin pulp suspension, recycled pulp suspension, additive suspension and solids-containing filtrate.

11. The method of claim 1, wherein at least a portion of said precipitation product penetrates into the fibers.

12. The process of claim 1, wherein said separating said fiber suspension into two separate flows comprises separating said fiber suspension by size.

13. The process of claim 1, wherein said first flow comprises a smaller size compared with said second flow.

14. The process of claim 1, wherein said second flow comprises untreated fibers.

15. A method for forming a thermoplastic composite material comprising an organic fiber material and a thermoplastic material, wherein the method comprises the steps of:

forming an aqueous suspension of the organic fiber material, wherein the organic fiber material includes at least one of a group consisting of natural fiber, wood fiber, bleached kraft fiber, dissolving pulp fiber, and microfibrillated cellulose;

separating said fiber suspension into a first flow and a second flow, wherein said second flow comprises refined fibers or fibrillated fibers or nanofibers;

bringing the first flow of said fiber suspension in contact with at least one additive, said additive being introduced into said fiber suspension, whereby said additive reacts to form an inorganic precipitation product at least onto the fibers, thereby forming an intermediate suspension wherein fiber-fiber bonds are reduced, wherein the precipitation product comprises a crystallized filler, and wherein the additives comprise carbon dioxide and lime milk, said carbon dioxide and lime milk being fed to the short circulation separately or simultaneously; and, introducing the second flow of said fiber suspension into said intermediate suspension, wherein the thermoplastic material is added into said intermediate suspension, thereby forming a thermoplastic composite material, wherein the thermoplastic material is a fiber formed from a thermoplastic selected from the group consisting of polyethylene (PE), polypropylene (PP), ethylene/propylene copolymer, polycarbonate (PC), polystyrene (PS), polyethylene terephthalate (PET), polylactic acid (PLA), polyhydroxybutylate, acrylonitrile/butadiene/styrene copolymer (ABS), styrene/acrylonitrile copolymer (SAN), polyoxymethylene (POM), biodegradable thermoplastics, starch-based thermoplastics, their derivatives, and mixtures thereof, wherein the intermediate suspension wherein fiber-fiber bonds are reduced is formed before addition of the thermoplastic material, and wherein the thermoplastic composite material comprises a web material formed in a fibrous web papermaking machine.

16. The process of claim 15, wherein said separating said fiber suspension into two separate flows comprises separating said fiber suspension by size.

17. The process of claim 15, wherein said first flow comprises a smaller size compared with said second flow.

18. The process of claim 15, wherein said second flow comprises untreated fibers.

19. A method for forming a thermoplastic composite material comprising a fiber material and a thermoplastic material, wherein the method comprises the steps of:

forming an aqueous fiber material suspension wherein the fiber material includes at least one of a group consisting of natural fiber, wood fiber, bleached kraft fiber, dissolving pulp fiber, and microfibrillated cellulose;

separating said fiber suspension into a first flow and a second flow, wherein said first flow comprises refined fibers or fibrillated fibers or nanofibers;

bringing the first flow of said fiber material suspension in contact with carbon dioxide and lime milk that reacts to form an inorganic precipitation product at least onto the fibers, wherein the precipitation product comprises precipitated calcium carbonate, thereby forming an intermediate suspension wherein fiber-fiber bonds are reduced; and, introducing the second flow of said fiber suspension into the intermediate suspension; wherein a thermoplastic material is added into said intermediate suspension, thereby forming a thermoplastic composite material, wherein the thermoplastic material is a fiber formed from a thermoplastic selected from the group consisting of polyethylene (PE), polypropylene (PP), ethylene/propylene copolymer, polycarbonate (PC), polystyrene (PS), polyethylene terephthalate (PET), polylactic acid (PLA), polyhydroxybutylate, acrylonitrile/butadiene/styrene copolymer (ABS), styrene/acrylonitrile copolymer (SAN), polyoxymethylene (POM), biodegradable thermoplastics, starch-based thermoplastics, their derivatives, and mixtures thereof, and, wherein the intermediate suspension wherein fiber-fiber bonds are reduced is formed before addition of the thermoplastic material, wherein the thermoplastic composite material comprises a web material formed in a fibrous web papermaking machine.

* * * * *